United States Patent [19]

George et al.

[11] Patent Number: 4,911,251

[45] Date of Patent: Mar. 27, 1990

[54] METHOD AND APPARATUS FOR ACTUATING A TUBING CONVEYED PERFORATING GUN

[75] Inventors: Flint R. George, Katy; Kevin R. George, Columbus, both of Tex.

[73] Assignee: Halliburton Company, Duncan, Okla.

[21] Appl. No.: 128,383

[22] Filed: Dec. 3, 1987

[51] Int. Cl.[4] ..... E21B 43/116

[52] U.S. Cl. ..... 175/4.54; 175/4.56; 166/55; 102/275.11

[58] Field of Search ..... 175/4.54, 4.55, 4.56; 166/55, 55.1, 55.2, 63, 297, 299; 102/322, 204, 275.11; 89/1.15

[56] References Cited

U.S. PATENT DOCUMENTS

| | | | |
|---|---|---|---|
| 2,719,485 | 10/1955 | Bendar | 175/4.56 X |
| 4,484,632 | 11/1984 | Vann | 166/297 |
| 4,509,604 | 4/1985 | Upchurch | 175/4.52 |
| 4,544,034 | 10/1985 | George | 175/4.54 X |
| 4,560,000 | 12/1985 | Upchurch | 166/55.1 |
| 4,564,067 | 1/1986 | Vann et al. | 175/4.52 |
| 4,610,312 | 9/1986 | Nelson et al. | 175/4.56 X |
| 4,614,156 | 9/1986 | Colle, Jr. et al. | 102/275.11 X |
| 4,619,333 | 10/1986 | George | 175/4.54 X |
| 4,629,001 | 12/1986 | Miller et al. | 175/4.56 X |
| 4,632,034 | 12/1986 | Colle, Jr. | 102/275.11 X |
| 4,650,010 | 3/1987 | George et al. | 175/4.56 X |
| 4,655,298 | 4/1987 | George et al. | 175/4.52 |
| 4,690,227 | 9/1987 | George et al. | 175/4.54 X |

OTHER PUBLICATIONS

Vannsystems Equipment—"Time Delay Firing Head", (1987).

Vansystems Equipment—"Annulus Pressure Firing Head", (1987).

Vannsystems Equipment Firer—"Releasable Annulus Pressure Firer", (1987).

Vannsystems Equipment—"Pressure Actuated Firing Head", (1987).

*Primary Examiner*—Bruce M. Kisliuk

*Attorney, Agent, or Firm*—Arnold, White & Durkee

[57] ABSTRACT

A firing head which is actuatable by either mechanical or hydraulic force. The firing head includes two pistons, one releasable through mechanical force, and the other releasable through hydraulic force. The first piston is secured in position until application of either an impact or an upward tension on an actuation piston. The second firing piston is responsive to hydrostatic pressure.

15 Claims, 5 Drawing Sheets

METHOD AND APPARATUS FOR ACTUATING A TUBING CONVEYED PERFORATING GUN

BACKGROUND OF THE INVENTION

The present invention relates generally to methods add apparatus for actuating tubing conveyed perforating guns to perforate subsurface formations, and more specifically relates to methods and apparatus which allow a tubing conveyed perforating gun to be actuated either mechanically or hydraulically.

Conventional firing heads for tubing conveyed perforating guns are typically actuated by either mechanical means or by hydraulical means. Mechanically-attuated firing heads are typically actuated by dropping a weighted member (commonly known as a "go-devil"), into the well to impact a piston and drive a firing pin into an initiator charge. An example of this type of firing head may be found in U.S. Pat. No. 3,706,344, issued Dec. 19, 1972 to Roy R. Vann, and assigned to the assignee of the present invention. Hydraulically-actuated firing heads typically contain a piston which is exposed on one side to the annulus pressure in the well surrounding the firing head. When the pressure in the annulus exceeds a predetermined actuation pressure, the piston will move and drive a firing pin into an initiator charge.

Additionally, firing heads are known which are actuated by a combination of mechanical action and hydraulic action. For example, a go-devil will be used to impact a striking piston and to move the piston from a first position to a second position. The movement of the striking piston to the second position will release a locking mechanism on a hydraulic piston which will then be moved in response to hydraulic pressure in the annulus to bring a firing pin into contact with an initiator charge. A firing head of this type is disclosed in copending application Ser. No. 040,217, filed Apr. 20, 1987 in the names of Flint R. George and Kevin R. George, and assigned to the assignee of the present application.

Well perforating operations take place under a wide variety of environmental conditions which can be extremely severe. Severe or unexpected environmental conditions may cause unexpected problems in satisfactorily performing tubing conveyed perforating jobs. For example, a mechanically-actuated firing head may be obstructed by particulate solids in the well which may prevent its operation. Additionally, factors such as deviation of the well may affect the ability to practically actuate a firing head mechanically. Similarly, it is not always possible to actuate a hydraulic firing head in a particular well. For example, defective or weak casing may make it impractical to apply increased pressure to the annulus to hydraulically actuate a firing head. Accordingly, it is desirable to have alternative methods for actuating the firing head.

Accordingly, the present invention provides a new method and apparatus for actuating a perforating gun. The apparatus allows the perforating gun to be actuated either hydraulically or mechanically. Additionally, a firing head in accordance with the present invention may be adapted to be responsive not only to longitudinal force in a downward direction, such as is accomplished with a weighted member, but also to longitudinal force in an upward direction, as may be applied with a wireline or slickline.

SUMMARY OF THE INVENTION

The present invention provides a firing head for actuating a tubing conveyed perforating gun which is adapted to be actuated either mechanically or hydraulically. Additionally, in a particularly preferred embodiment, the firing head may be actuated mechanically by either an impact on the firing head or by tension placed upon a portion of the firing head. In this particularly preferred embodiment, the firing head includes two firing pistons, each of which is movable from a first, "normal", position to a second position which will actuate an initiator charge, to initiate either a burn or an explosion which will result in detonation of the perforating gun. Preferably, the first firing piston is releasable through downward or upward movement of an actuation piston. This actuation piston preferably includes a head portion which may receive the impact from a go-devil detonating bar, or which may be easily latched onto by an overshot or similar mechanism. The second firing piston is preferably responsive to hydraulic pressure applied to the interior of the firing head.

In a particularly preferred embodiment, the first and second firing pistons are concentric with one another and at least partially coextensive with one another; and are in concentric relation to the actuation piston. In this embodiment, the first firing piston is securely retained in its first position by a plurality of releasable segments, or collets which are held in position by the actuation piston. However, in this embodiment the second firing piston is retained in its first position by a plurality of shear pins. Accordingly, while the first firing piston is releasable only through movement of the actuation piston, the second firing piston is releasable through hydraulic pressure acting upon the second piston and shearing the shear pins.

BRIEF DESCRIPTION OF THE DRAWINGS

FIG. 8 depicts an alternative embodiment of a firing head in accordance with the present invention, illustrated in vertical section.

DETAILED DESCRIPTION OF A PREFERRED EMBODIMENT

Figure 1:
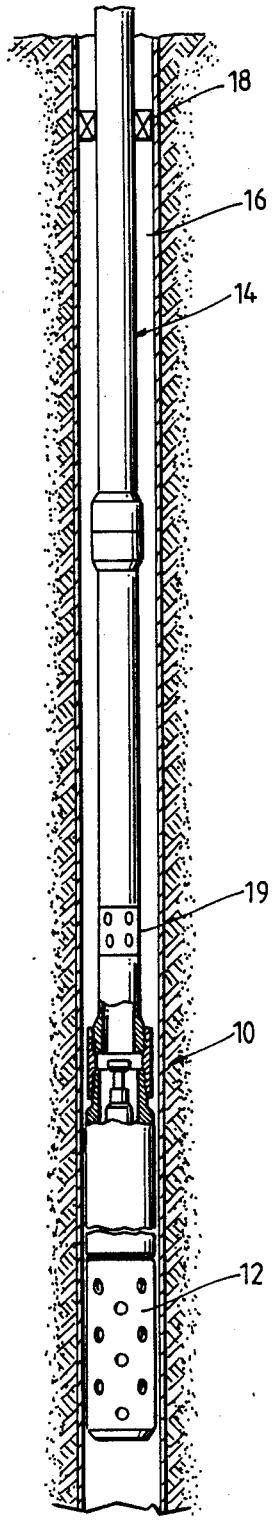
FIG. 1 depicts a firing head in accordance with the present invention in a tool string an operating configuration in a wellbore, illustrated partially in vertical section.

Referring now to the drawings in more detail, and particularly to FIG. 1, therein is depicted a firing head 10 in accordance with the present invention, in an operating configuration in a wellbore. Firing head 10 is situated above a perforating gun 12 in a tool string, indicated generally at 14. Tool string 14 extends into a wellbore 16. Tool string 14 may include a packer 18 to isolate an upper portion of the borehole from a lower portion of the borehole when perforating gun 12 is positioned adjacent a formation to be perforated. In one preferred embodiment, a ported member 19 will be included within tool string 14, such that the interior of firing head 10 will be exposed to pressure in wellbore 16.

Figure 2:
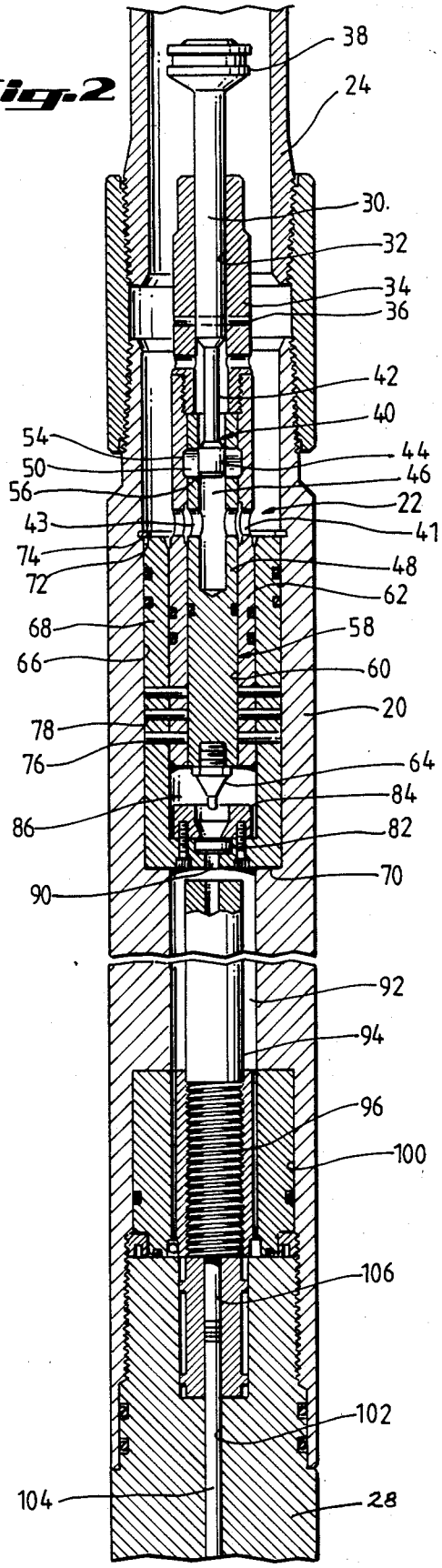
FIG. 2 depicts the firing head of FIG. 1 in greater detail and in vertical section.
Figure 3:
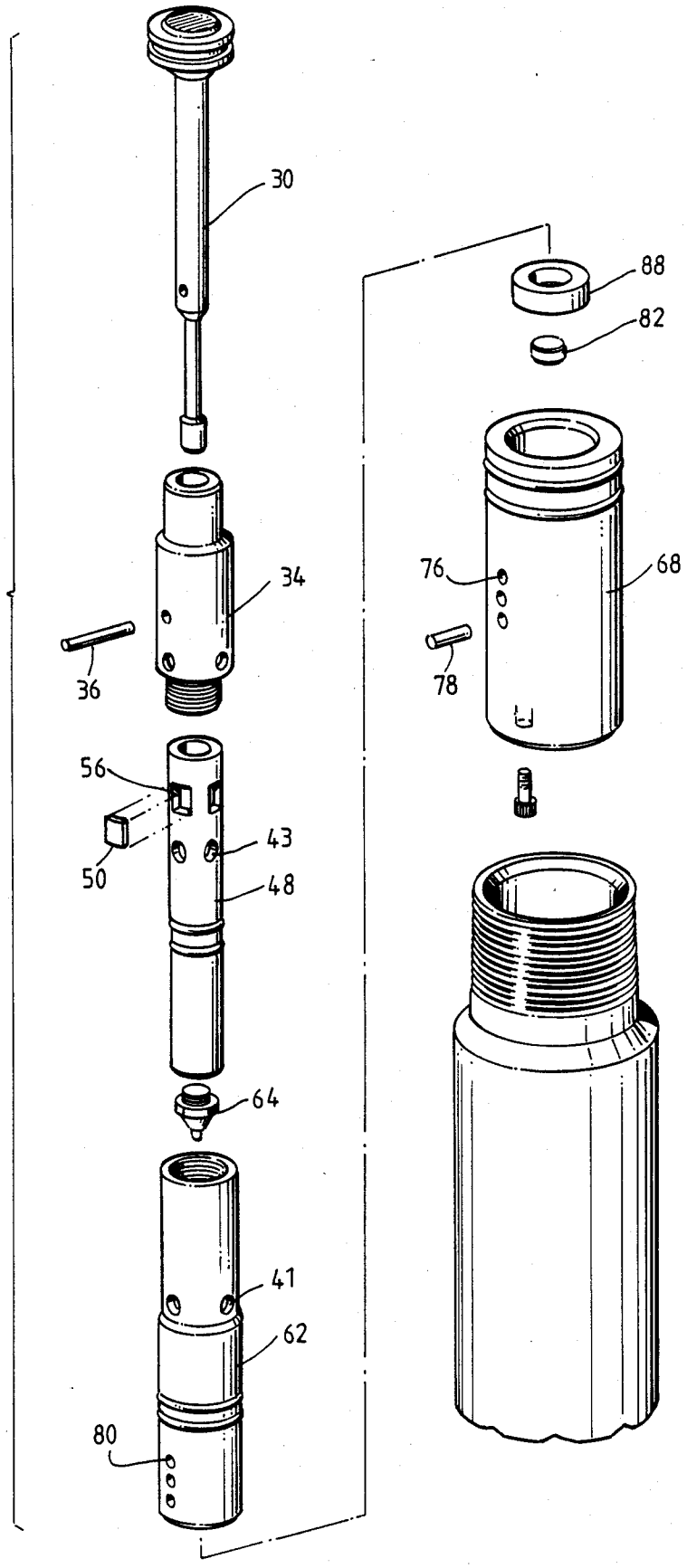
FIG. 3 depicts the actuation mechanism of a firing head in accordance with the present invention in an exploded view.
Figure 4:
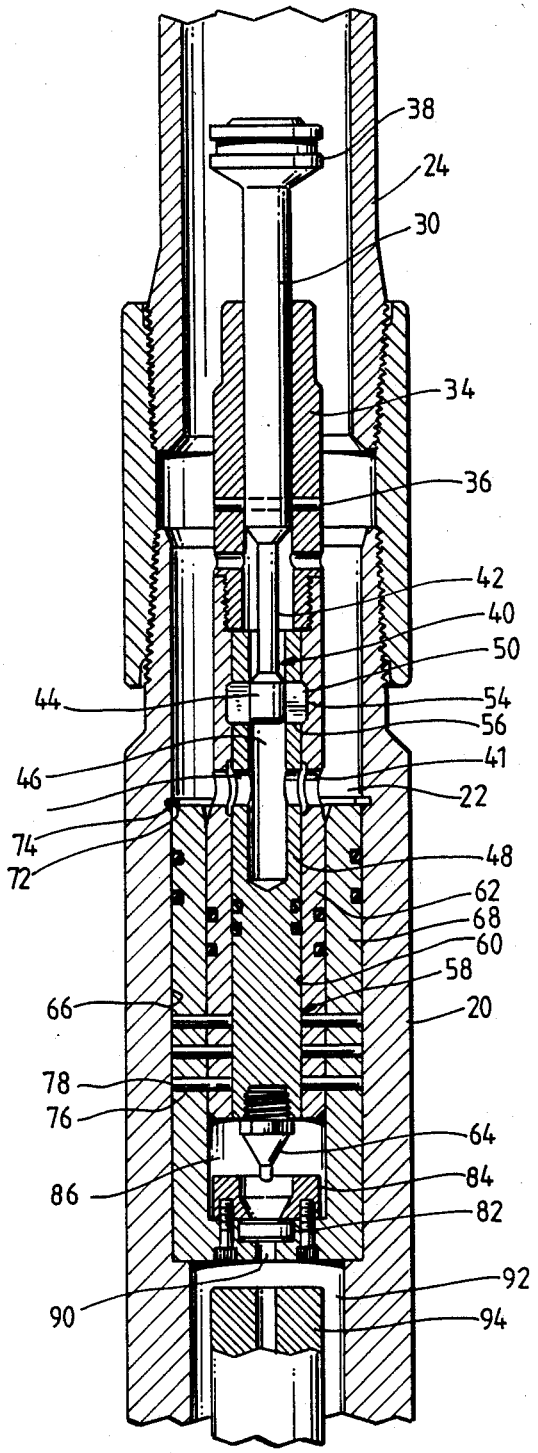
FIG. 4 depicts the actuation mechanism of a firing head in accordance with the present invention prior to actuation, illustrated in vertical section.

Referring now to FIG. 2, therein is depicted an exemplary embodiment of firing head 10 in vertical section. Firing head 10 includes a primary housing 20 in which an actuation mechanism, indicated generally at 22, is retained. Primary housing may be one piece, or may include submembers, such as housing member 24, which may be joined, such as by a threaded coupling 26, to primary housing 20. Primary housing 20 will preferably couple at a lower end to firing head sub 28 in conventional manner.

As will be apparent from the discussion to follow, actuation mechanism 22 includes two firing pistons. A first firing piston 48 is preferably secured in place by collets and is released through mechanical actuation of an actuation piston 30. Second firing piston 62 is preferably secured in place by shear pins and is released through hydraulic pressure. Actuation mechanism 22 includes actuation piston 30 retained within a bore 32 in mandrel 34. Actuation piston 30 is longitudinally movable relative to mandrel 34, but is initially secured in a first, "normal", position by a shear pin 36. Actuation piston 30 includes a first end 38 which is adapted both to receive an impact to shear pin 36, or to be retrieved, such as by with an overshot, so as to receive an upward tension to shear shear pin 66, and to thereby allow longitudinal movement of actuation piston 30 relative to mandrel 34.

A second end of actuation piston 30, indicated generally at 40, includes a first portion 42 of reduced diameter. Second end 40 of actuation piston 30 also includes a second portion 44 of an enlarged diameter relative to first portion 42 of actuation piston 30. Second portion 44 of actuation piston 30 extends into a recess 46 in first firing piston 48. Mandrel 34 is coupled to second firing piston 62. First firing piston 48 is secured in fixed position relative to mandrel 34 and second firing piston 62 by a plurality of releasable segments, or "collets", 50 which cooperatively engage recesses 54 in second firing piston 62 and apertures 56 in first firing piston 48. Collets 50 are held in position by enlarged second portion 44 of actuation piston 30. First firing piston 48 includes a second end, indicated generally at 58, which sealingly engages bore 60 in second firing piston 62. A firing pin 64 is coupled to second end 58 of first firing piston 48. Unless otherwise noted all sealed engagements described herein may be provided through use of conventional o-ring-type seals.

Second firing piston 62 is slideably and sealingly received within a bore 66 in securing sleeve 68. Securing sleeve 68 is received within housing 20 and preferably rests against a shoulder 70 in housing 20. Securing sleeve 68 is retained in position in housing 20 such as by a snap ring 72 which engages a relief 74 in housing 20. A plurality of apertures 76 are formed in securing sleeve 68 to receive shear pins 78. Shear pins 78 similarly engage apertures 80 in second firing piston 62. First and second firing pistons 48 and 62, respectively, preferably each include apertures 43 and 41, respectively, to allow fluid communication between the interior of housing 20 and recess 46 in first firing piston 48.

Firing pin 64 preferably includes a tapered contour designed to impact and detonate an initiator charge 82, such as a primer assembly, which is sealingly retained within a bore 84 in securing sleeve 68. Primer assembly 82 is secured to securing sleeve 68 by a primer block 88 which is preferably boltably secured t securing sleeve 68. Securing sleeve 68 includes an aperture 90 which allows the jet of hot gases emitted by the ignition of primer assembly 82 to enter a chamber 92 in housing 20. Secured within chamber 92 is a delay element assembly 94. Delay element assembly 94 is threadably secured at 96 to a receiving block 98 which is sealingly received within a bore 100 in housing 20. The sealing engagements of primary firing piston 48 with secondary firing piston 62; of secondary firing piston 62 with securing sleeve 68; of receiving block 48 with housing 20; and of securing sleeve 68 with housing 20, serve to form chambers 86 and 92 (on either side of initiator charge 82), which will be at atmospheric pressure. Accordingly, first firing piston 48 and second firing piston 62 are fluid responsive pistons responsive to pressure inside housing 20.

Delay element assembly 94 is a pyrotechnic device which, upon ignition of an internal initiator, will burn for a period of time until detonating an explosive charge to detonate a booster charge to in turn detonate the perforating gun. In a presently preferred embodiment, delay element assembly 94 will burn for approximately seven minutes after initial ignition. However, other delay times clearly may be utilized. The structure of a delay element assembly suitable for use with the present invention is described in U.S. Pat. No. 4,632,034, issued Dec. 30, 1986 to Colley, Jr. The specification of U.S. Pat. No. 4,632,034 is incorporated herein by reference for all purposes.

Perforating sub 28 coupled to lower end of housing 20 includes a central bore 102. Contained within bore 102 is a length of a conventional explosive type detonating cord 104 which extends through the perforating gun (32 in FIG. 1), and includes a booster charge 106 at a first end. Once booster charge 106 is detonated by delay element assembly 94, booster charge 106 and detonating cord 102 facilitate detonation of the perforating gun in a conventional manner.

Figure 5:
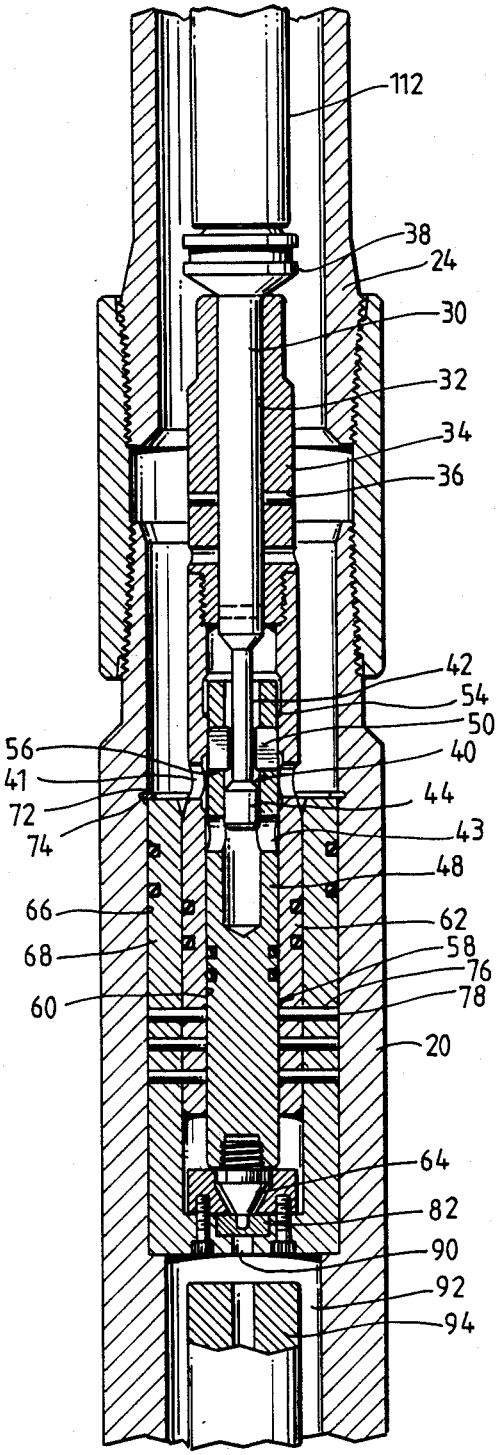
FIG. 5 depicts the actuation mechanism of FIG. 4 after actuation by impact from a detonating bar.

Referring now to FIGS. 4–7, therein is shown firing head 10 prior to actuation, and after actuation by each of three different methods. Referring specifically to FIG. 5, therein is shown firing head 10 after actuation by the dropping of a weighted member, such as a go-devil, 112 into contact with actuation piston 30. As go-devil 112 contacts actuation piston 30, actuation piston 30 is moved longitudinally downwardly. As actuation piston 30 is moved downwardly, recessed portion 42 of actuation piston 30 is brought into coextensive relation with collets 50. The reduced diameter of section 42 of actuation piston 30 allows collets 50 to fall out of engagement with recesses 54 in second firing piston 62. Annulus fluid pressure in housing 20 acts, through ports 41 and 43, on first firing piston 48, driving it longitudinally with sufficient impact to cause firing pin 64 to activate initiator 82. In a preferred embodiment, 1000 psi pressure is sufficient to drive first firing piston 48.

Figure 6:
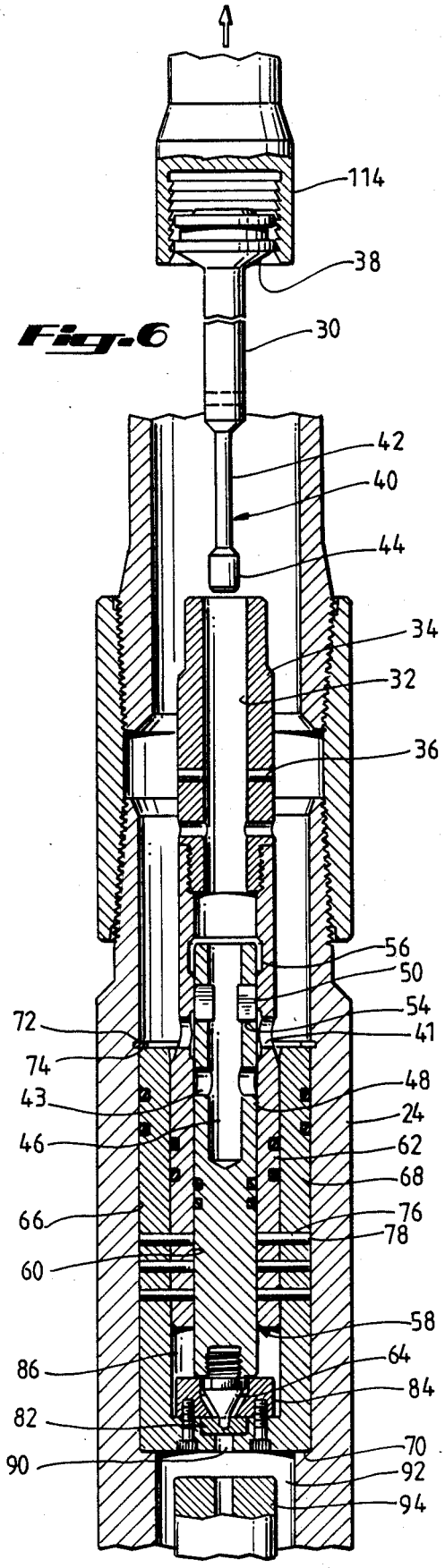
FIG. 6 depicts the actuation mechanism of FIG. 4 after actuation with an overshot.

Referring now specifically to FIG. 6, therein is depicted firing head 10 when it is actuated by moving actuation piston upwardly such as through use of an overshot 114. Actuation in this manner is similar to actuation through use of a go-devil, with the exception that as actuation piston 30 is moved upwardly, enlarged end 44 of actuation piston 30 is moved upwardly, out of the proximity of collets 50. Collets 50 then move out of recesses 54 in second firing piston 62, and first firing piston 48 will move downwardly, causing firing pin 64 to actuate initiator 82.

Figure 7:
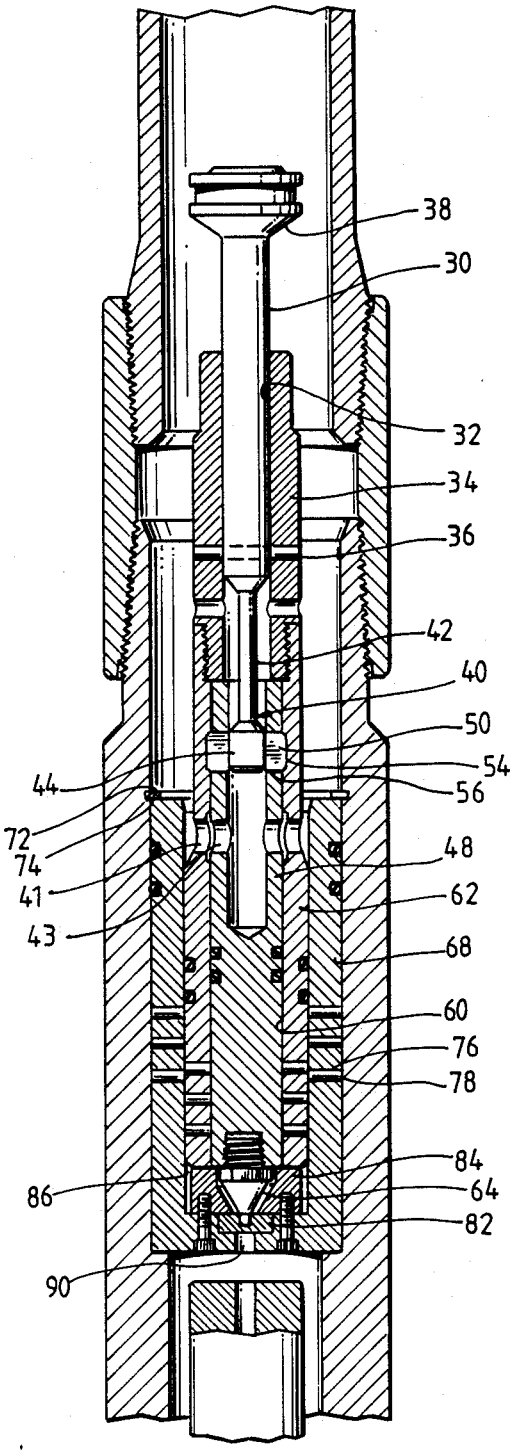
FIG. 7 depicts the actuation mechanism of FIG. 4 after actuation by application of hydraulic pressure.
Figure 3:
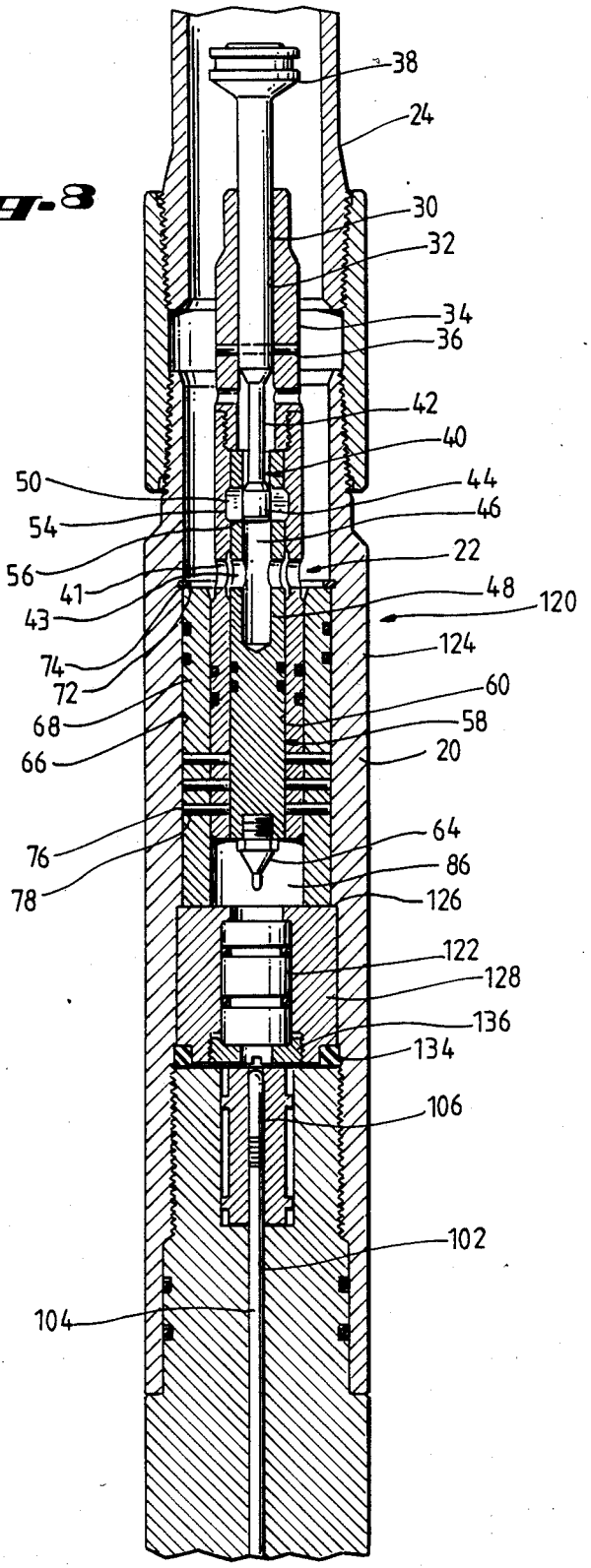

Referring now to FIG. 7, therein is shown firing head 10 after actuation solely through use of hydrostatic pressure. As indicated previously, chamber 86 beneath first and second firing pistons 48 and 62, respectively, will be at atmospheric pressure. Also as indicated earlier herein, second firing piston 62 is retained in a first, upper, position by shear pins 78. Once hydrostatic pressure on the upper side of second firing piston 62 reaches a threshold value sufficient to shear shear pins 78, second firing piston 62, along with mandrel 34 and first firing piston 48, will be driven downwardly to bring firing pin 64 into operative contact with initiator 82. Thus, actuation mechanism 22 acts as a piston within securing sleeve 68 in response to hydrostatic pressure.

Those skilled in the art will recognize that although the operation of firing head 10 has been described in the context of utilizing annulus pressure within housing 20 to move first and second firing pistons 48 and 62, the interior of firing head 10 may instead be exposed to hydrostatic pressure in the tubing string to effect operation of first and second firing pistons 48 and 62.

Referring now to FIG. 8, therein is shown an alternative embodiment of a firing head 120 in accordance with the present invention. Firing head 120 differs from firing head 10 in that actuation mechanism 22 will impact a detonator explosive charge 122 to immediately detonate perforating gun 12, rather than initiating an initiator charge to begin a time-delayed detonation of perforating gun 12 as was done with the embodiment of FIGS. 1–7. Because firing head 120 is similar in structure and operation to firing head 10, only the essential differences will be addressed herein.

Housing 124 of firing head 120 includes a ledge 126 against which an ignition block 128 is seated. Ignition block 128 includes a central bore 130 which houses a conventional initiator 122. Initiator 122 is sealed within bore 130, such as by o-rings 132, to assure that chamber 86 is at atmosphere pressure. Ignition block 128 may be retained within housing 124 by a retaining ring 134, or by any other conventional means. Detonator 122 is preferably retained within ignition block 128 by a retaining ring 136. The function of actuation mechanism 22 of firing head 120 is identical to that as previously described with respect to firing head 10 of FIGS. 1–7. Thus, three alternative methods of actuation are provided to actuate firing head 120 and to thereby immediately detonate perforating gun 12.

Many modifications and variations may be made in the techniques and structures described herein without departing from the spirit and scope of the present invention. Accordingly, it should be readily understood that the methods and embodiments described and illustrated herein are exemplary only and are not to be considered as limitations on the scope of the present invention.

What is claimed is:

1. A firing head for a tubing conveyed perforating gun, comprising:

a housing;

first and second firing pistons within said housing, each piston moveable from a first position in said housing to a second position in said housing;

a first retention mechanism operatively coupled to said first firing piston to retain said first firing piston in its said first position, said first retention mechanism being releasable at least partially in response to a mechanical force supplied either generally longitudinally downwardly or generally longitudinally upwardly in said firing head;

a second retention mechanism operatively coupled to said second firing piston to retain said second firing piston in its first said position, said second retention mechanism being releasable at least partially in response to hydraulic force applied in said firing head; and a single initiator assembly adapted to cause detonation of said perforating gun, said initiator responsive to movement of either of said first and second firing pistons.

2. The firing head of claim 1, wherein said first firing piston includes a firing pin adapted to impact said initiator.

3. The firing head of claim 2, wherein said movement of said second firing piston causes movement of said first firing piston to cause said firing pin to impact said initiator.

4. The firing head of claim 1, wherein said first and second firing pistons are in coaxial relation to one another.

5. The firing head of claim 1, wherein said first retention mechanism comprises an actuation piston moveably responsive to mechanical force to release and allow movement of said first firing piston.

6. A firing head for actuating a tubing conveyed perforating gun, comprising:

a housing; and an actuation mechanism within said housing, said actuation mechanism comprising, an actuation piston, a first firing piston movable from a first position to a second position, said first firing position operatively coupled to said actuation piston, means for releasably retaining said first firing piston in said first position, said releasable retaining means being responsive to mechanical force applied to move said actuation piston either upwardly or downwardly, a second firing piston movable from a first position to a second position, said second firing piston being in generally concentric and at least partially coextensive relation with said first firing piston, and means for releasably retaining said second firing piston in said first position, said releasable retaining means being releasable through application of hydraulic pressure to said actuation mechanism.

7. The firing head of claim 6, wherein said means for retaining said second firing piston in said first position comprises at least one shear pin adapted to retain said second firing piston in a first position relative to said housing.

8. The firing head of claim 6, wherein said first and second firing pistons are in concentric relation to each other, and wherein said first and second firing pistons are in concentric relation to said actuation piston.

9. A firing head for actuating a tubing conveyed perforating gun, comprising:

a housing; and an actuation mechanism within said housing, said actuation mechanism comprising, an actuation piston, a first firing piston movable from a first position to a second position, said first firing position operatively coupled to said actuation piston, means for releasably retaining said first firing piston in said first position, said releasable retaining means being responsive to mechanical force applied to said actuation piston, said means for releasably retaining said first firing piston in said first position comprising releasable segments normally engaging said first firing piston and said second firing piston, said segments retained in said engaging position by said actuation piston and releasable in response to movement of said actuation piston, a second firing piston movable from a first position to a second position, said second firing piston being in generally coaxial and concentric relation with said first firing piston, and means for releasably retaining said second firing piston in said first position, said releasable retaining means being releasable through

10. A firing head for actuating a tubing conveyed perforating gun, comprising:

a housing;

an actuation mechanism within said housing, said actuation mechanism comprising:

an actuation piston moveable from a first position in response to force applied generally along the longitudinal axis of said perforating gun proximate said firing head to either of second or third positions on opposing sides of said first position;

a first firing piston in coaxial relation to said actuation piston, said first firing piston moveable from a first position to a second position, said first firing piston being retained in said first position when said actuation piston is in its respective said first position;

a second firing piston in coaxial and at least partially coextensive relation to said first firing piston, said second firing piston being moveable from a first position to a second position;

means for releasably retaining said second piston in said first position, said releasable retaining means being releasable in response to hydraulic pressure; and an initiator responsive to movement of said first or second firing pistons to cause detonation of said perforating gun.

11. The firing head of claim 10, wherein said first firing piston is secured in fixed relation to said second firing piston by said actuation piston when said actuation piston is in said first position.

12. The firing head of claim 10, wherein said actuation mechanism further comprises:

means for retaining said first firing piston in fixed relation to said second firing piston, said retaining means releasable through movement of said actuation piston away from said first position.

13. The firing head of claim 10, wherein said actuation mechanism further comprises a plurality of releasable members which engage said first and second firing pistons when said actuation piston is in said first position.

14. The firing head of claim 10, wherein said initiator comprises a primer assembly operatively associated with a delay element.

15. The firing head of claim 10, wherein said initiator comprises a detonator explosive charge.

* * * * *

UNITED STATES PATENT AND TRADEMARK OFFICE

CERTIFICATE OF CORRECTION

PATENT NO. : 4,911,251

DATED : March 27, 1990

INVENTOR(S) : Flint R. George and Kevin R. George

It is certified that error appears in the above-identified patent and that said Letters Patent is hereby corrected as shown below:

In column 3, line 33, delete "66" and in its place add --36--.

In column 7, line 24, after through, add --application of hydraulic pressure to said actuation mechanism.--

Signed and Sealed this

Nineteenth Day of March, 1991

*Attest:*

HARRY F. MANBECK, JR.

*Attesting Officer*

*Commissioner of Patents and Trademarks*